United States Patent [19]

Stinessen et al.

[11] Patent Number: 5,044,440

[45] Date of Patent: Sep. 3, 1991

[54] UNDERWATER STATION FOR PUMPING A WELL FLOW

[75] Inventors: Kjell O. Stinessen; John L. Cotton; Jan S. Christensen, all of Oslo, Norway

[73] Assignee: Kvaerner Subsea Contracting, Saker, Norway

[21] Appl. No.: 460,398

[22] Filed: Jan. 3, 1990

[30] Foreign Application Priority Data

Jan. 6, 1989 [NO] Norway ..... 890057

[51] Int. Cl.[5] ..... E21B 43/01

[52] U.S. Cl. ..... 166/344; 166/356; 166/357; 166/105.5

[58] Field of Search ..... 166/338, 339, 335, 344, 166/351, 356, 357, 360, 265, 105.5, 105.6; 210/170, 188; 55/189-193; 285/18

[56] References Cited

U.S. PATENT DOCUMENTS

| | | | |
|---|---|---|---|
| 3,552,903 | 1/1971 | Townsend | 166/36 |
| 3,638,720 | 2/1972 | Thomas | 166/357 X |
| 3,643,736 | 2/1972 | Talley | 166/357 X |
| 3,754,380 | 8/1973 | McMinn et al. | 166/357 X |
| 4,169,507 | 10/1979 | Szymczak | 166/340 |
| 4,438,817 | 3/1984 | Pokladnik et al. | 166/341 |
| 4,527,632 | 7/1985 | Chaudot | 166/357 |
| 4,848,475 | 7/1989 | Dean et al. | 166/357 |

*Primary Examiner*—Ramon S. Britts
*Assistant Examiner*—Terry Lee Melius
*Attorney, Agent, or Firm*—Merchant & Gould

[57] ABSTRACT

The invention relates to an underwater station for pumping a well flow, comprising a separator for separating the well flow into liquid (oil/water) and gas, a pump assembly comprising a pump with a motor, and a compressor assembly comprising a compressor with a motor, as well as fluid carrying conduits between the separator and pump, and compressor, respectively. Separator, pump assembly, and compressor assembly are assembled into a compact unit with said three components arranged in a column structure, with pump assembly placed downmost, then separator, and with compressor assembly provided uppermost. The fluid carrying conduits are designed for connection (interface) in the bottom of said column structure.

6 Claims, 5 Drawing Sheets

UNDERWATER STATION FOR PUMPING A WELL FLOW

BACKGROUND OF THE INVENTION

The invention relates to an underwater station for pumping a well flow, comprising a separator to separate the well flow into liquid (oil/water) and gas, a pump assembly comprising a pump with a motor, and a compressor assembly comprising a compressor with a motor, and fluid carrying conduits between separator and pump, and compressor, respectively.

Offshore oil and gas production to day commonly is carried out as follows:

Production wells are drilled from a platform down into the hydrocarbon reservoir. The platform is positioned above the height of waves on a substructure which stands on the sea floor or is afloat. Well head valves which shut off the reservoir pressure, are placed on the platform, commonly straight above the production wells.

Oil which is present under high pressure in the hydrocarbon reservoir, contains much dissolved gas. The capability of the oil to hold such dissolved gas will decrease with decreasing pressure and increasing temperature. When oil flows up through the production well from the reservoir and past the well head valve on the platform, resulting in decreasing pressure, gas is, thus, released from the oil. On top of the well head valve a mixture of oil and gas (in fact a mixture of liquid (oil/water and gas)) will, thus, emerge.

This mixture of liquid and gas is transported to a processing plant which is generally provided on the platform. The function of the processing plant is mainly to separate oil and gas and to make the oil suitable for transport and the gas suitable for transport or to be returned into the reservoir.

Since the process requires energy, and hydrocarbons are inflammable, a number of auxiliary functions and emergency systems are required about the processing plant. Furthermore, operation of processing, auxiliary, and emergency systems requires operators who, in turn, need accommodation and a number of other functions. Plants, thus, tend to be large and expensive both as regards investment and operation. On great sea depths the cost problem is even greater when the platform with the plant is to be provided on an expensive substructure which is anchored to the sea floor or afloat.

Large developing projects aiming at reduced cost are underway at present. Among others, technology was developed to permit the well head valves to be placed on the sea floor—so called underwater production plants. This is of great economic importance, because the number of platforms required to drain a hydrocarbon reservoir may be reduced. An underwater production plant is placed above an area of the hydrocarbon reservoir which cannot be reached by the aid of production wells from the platform.

Production wells of an underwater production plant are drilled from floating or jackup drilling vessels. Oil and gas from the hydrocarbon reservoir flow upwards and past the well head valves on the sea floor, and then flow in the shape of a two-phase flow (oil and gas in a mixture) in a pipeline which connects the underwater production plant with the platform. Such two-phase flows will entail slugs of liquid causing hard impacts of liquid, uncontrolled flow conditions, and considerable pressure drop in the pipeline. Consequently, the distance between the underwater production plant and the platform must not be large. At present, a practical limit is considered to be approximately 15 km.

Technical solutions which might increase this distance will have a great economic potential. The extreme consequence might be that the platform becomes redundant, with the well head valves placed on the sea floor close to the hydrocarbon reservoir, and the processing, auxiliary, and emergency systems provided on land.

Extensive developing projects are underway at present to solve the problem of conveying oil/gas mixtures across large distances. There are, thus, approaches to provide the mixture of oil and gas with pressure by placing two-phase pumps on the sea floor to compensate for pressure drop. Other approaches involve separation of oil and gas on the sea floor to permit oil and gas to be pumped in separate pipelines to a processing plant. Oil and gas are then provided with the necessary energy for efficient transport to the terminal. Liquid and gas are conveyed in separate pipelines, but the liquid and gas pipelines may, if desired, converge into a multi-phase conduit, if this is deemed optimal.

Production from a number of wells may be collected to be conveyed in a common flow. A problem in this connection is occurrence of different well flow pressure. This problem may be solved by conducting the well flows, via separate stations where the well flow pressure is adapted to a common value, after which the well flows are combined in a manifold station for further transport.

The invention was developed especially in connection with the demand for pumping a well flow from offshore petroleum fields to the shore. Transport of an unprocessed well flow across great distances to land-based processing plants offers great potential profit. By placing as much as possible of the heavy and bulky processing plant on land, optimal design is much more at option since there are no longer limitations as to weight and space like the limitations found on fixed and, especially, floating platforms.

To be able to transport a well flow across great distances to the shore or to existing processing platforms where there is surplus capacity, underwater pumping stations will be required. There are a number of advantages in placing such stations on the sea floor. Compressors and pumps will be located in the middle of a coolant (sea water) of substantially constant temperature. The hazard of explosions is eliminated and the plant will not be affected by wind and waves and it will not be covered with ice. Great saving may be achieved in connection with platform costs, quarter costs and transport of staff and equipment to and from land.

There are, however, certain disadvantages and unsolved problems in connection with underwater pumping stations. Simple daily inspection and maintenance will, thus, be impossible. Systems and components for adjustment and monitoring remote underwater stations involve untried technology. Necessary electrical power must be transmitted across great distances and connection with equipment of the underwater station must be achieved in a satisfactory manner.

All equipment and all components must be high quality and show a high degree of reliability. Maintenance must be arranged according to predetermined systems, permitting replacement of equipment. As mentioned, the present invention was developed especially in connection with the demand for a pumping station which can pump a well flow from the field and to a terminal ashore or on a nearby platform. In this connection a special object of the invention is to permit simple mounting and dismantling of a pump unit on the sea floor. Mounting and dismantling should be possible by the aid of unattended diving vessels and/or hoisting devices which are surface controlled. Service/maintenance which should occur when complete units are replaced, should be possible at desired intervals of at least 1–2 years. Control and adjustment of operations should be kept at a minimum and, preferably, it should be possible to make do without monitoring the station during operation.

SUMMARY OF THE INVENTION

According to the invention an underwater station as stated above is, thus, proposed, which is characterized by having the components, i. e. separator, pump assembly, and compressor assembly joined into a compact unit with all three components provided in a column structure, with the pump assembly lowermost, the separator on top of the pump, and the compressor assembly uppermost, and by the fact that fluid conducting pipelines are designed for being connected at the bottom of said column structure. The fluid conducting pipelines are, advantageously, assembled to a common connection unit.

By the aid of this invention a compact unit is, thus, achieved which comprises a simple separator, a pump, and a compressor, and which may be positioned on the sea floor. This unit will split the hydrocarbon flow from one or a number of underwater wells into a gas phase and a liquid phase. Then the pressure of gas and liquid is increased so that the product flow may be conveyed across great distances. Transport from the unit may either be in a common pipeline or in separate pipelines for oil and gas. The compact unit may be installed by the aid of a drilling rig or, e. g. a modified vessel with a large moon-pool. Installation and/or replacement may be carried out in a simple manner. Service/maintenance to be carried out when the complete unit is replaced, may occur at desired intervals of at least 1–2 years. Operational control and adjustment will be kept at a minimum.

The compact design means that long fluid carrying conduits are avoided in the station and this, in turn, means that loss of pressure in such conduits may be avoided. The number of necessary valves and connections will be much reduced. Due to the fact that fluid conduit connections are mostly avoided in the station, undesirable influences due to so called slugs, i.e. liquid slugs and gas bubbles, are also avoided. The compressor being the uppermost means, automatic gas draining is also achieved. Any liquid forming in the compressor means will flow down from the compressor or gas portion. Gas will often be at dew point, and condensate will, thus, probably form in gas carrying portions. The underlying pump assembly will be self-draining as well as the compressor assembly above. Condensated gas will drip down from the upper compressor assembly and, correspondingly, any possible gas in the underlying pump assembly will bubble up into the separator.

Even though the new unit is, in fact, provided by two separate assemblies being joined, the assemblies, i.e. compressor assembly and pump assembly, may be controlled separately, so that a large range of mixtures may be covered. If correspondingly designed, the new underwater station may, thus, handle well flows from substantially pure gas to pure oil.

The underwater station fully utilizes the suitable environment in which it is placed, i.e. the sea water, for cooling compressor and pump.

In a preferred embodiment the pump inlet is directly connected with the liquid chamber of the separator, and the compressor inlet is directly connected with the gas chamber of the separator. In this manner the fluid carrying connecting conduits are reduced to an absolute minimum, with resulting advantages, and said self-draining effect is fully utilized.

The separator may, advantageously, be in the shape of a container which is integrated in the column structure and has a conical bottom to form the liquid chamber or sump. In connection with precipitation of unavoidable impurities (particles, etc.), this will provide for special advantages. Such impurities will be drained into the conical bottom portion, from which they may be removed or will, in practice, be sucked into the pump to be transported with the liquid phase.

In an especially preferred embodiment of the underwater station compressor and pump are designed to be centrifugal machines, compressor and pump then being vertical with the compressor motor uppermost and with the pump motor below the pump in the column structure.

This will in an especially advantageous manner permit the column structure to be fitted into a framework comprising guide funnels for cooperation with guide posts in a standard module-pattern.

The gas chamber of the separator may, advantageously, be thermally insulated, e.g. provided with heating means, and the liquid chamber of the separator may also, advantageously, be provided with cooling means, e.g. external cooling ribs.

Insulation is important, because it will prevent formation of condensate, and heating and insulation will, thus, stabilize the phases.

The compressor and its motor, and if desired a gear, may in an especially advantageous manner be provided in a common pressure shell the bottom portion of which is designed to form a reservoir for bearing luboil.

Such a compressor assembly will represent a closed system, free of external influences. Since it is possible to work with the same gas atmosphere and the same pressure in various portions of the unit, requirements for internal sealing (shaft sealing) are almost eliminated. It is necessary to prevent lubricant from disappearing from oil lubricated bearings. This may be achieved by installing suitable sealings, which will be of a simpler design and have much longer life than sealings which have to withstand pressure gradients. To a necessary extent suitable barriers may also be used against too much gas circulation and here it will be possible to avoid rotating sealings.

The compressor assembly will, thus, be autonomous to a maximum degree, which is vital in connection with offshore utilization, in an underwater station.

In case of compression of gases causing condensate to be formed, which is the case especially when hydrocarbonic fluids are compressed, any such condensate will flow down in the pressure shell and collect in a sump. According to the invention measures may advantageously be taken to prevent condensate from being formed inside the unit, but to be collected and returned to the compressor. This may be achieved by a fluid conduit connected with the inside of the pressure shell, with a cooling stretch arranged in the fluid conduit and, possibly, a condensate trap the gas portion of which is connected with the interior of the pressure shell. In such an embodiment of the compressor assembly condensate will be prevented from collecting in the pressure shell. Condensate is separated outside the pressure shell proper, i.e. in the fluid conduit stretch, and will flow to the inlet side of the compressor. Condensate is, thus, advantageously kept inside limits in the pressure shell, where it will not damage lubricating oil in the presure shell, which is at the bottom of the pressure shell, in said reservoir.

The pump and its motor may also, advantageously, be provided in a common pressure shell which is closed towards the outside.

The common connection means may, advantageously, be a connector intended to be connected with a coupling head with corresponding fluid passage. Such a connector may in a most advantageous manner comprise pressure fluid actuated clamping blocks which are to encompass a coupling flange on the head, and in the connector, respectively, about said fluid passages. The clamping blocks are, in turn, connected with a retaining ring which is axially displaceable inside the connector.

Such a connector design permits an especially simple vertical connection of the compact unit at its interface.

The new station may advantageously be used for operating wells which are combined to a manifold station. The well flow pressure will often vary between separate wells, and in some stations mutual adaption of the well pressure may be carried out. If one well, e.g. has a well flow presure of 150 bars, and adjacent wells have well flow pressures of 75 bars, 50 bars, and 100 bars, the well flow pressure may be adapted to a common value by the aid of separate pumping stations. One well flow may also be shunted past such a pumping station if its pressure is high enough so that adaption at the pumping station is not necessary.

Both phases may, advantageously, be measured at the station or stations. In this manner the flow from each well may be measured.

BRIEF DESCRIPTION OF THE PREFERRED EMBODIMENT(S)

The invention is disclosed in more detail below, with reference to the drawings, where:

DETAILED DESCRIPTION OF THE DRAWINGS

Figure 1:
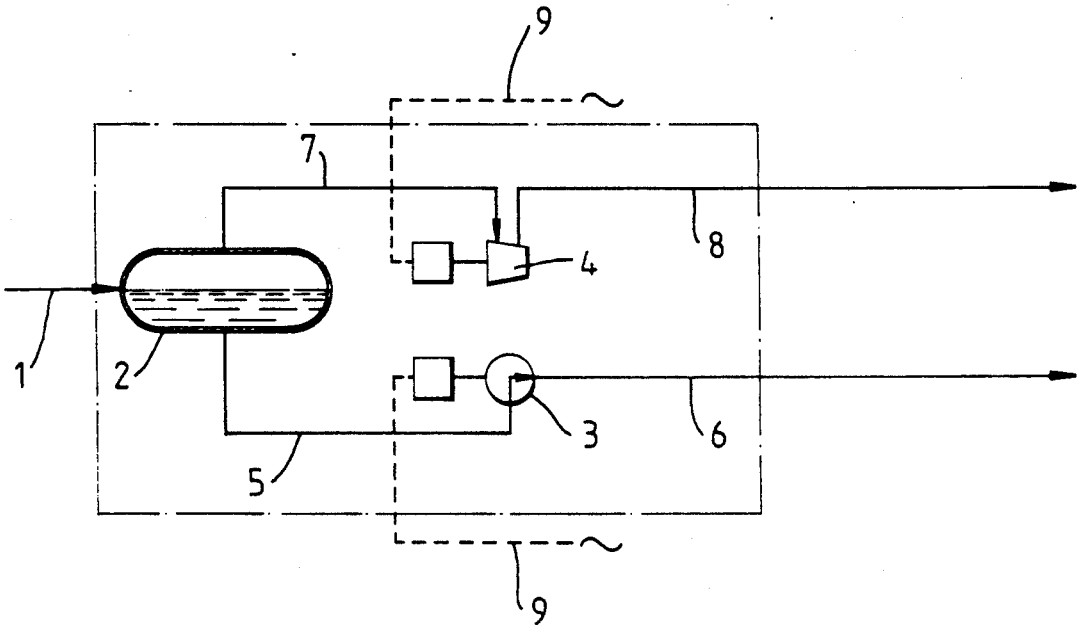
FIG. 1 is a diagrammatical view of an underwater station with a separator, a pump, and a compressor.

The underwater station diagrammatically shown in FIG. 1 is an underwater station for production of hydrocarbons. It comprises a separator 2, a pump 3, and a compressor 4. Separator 2 receives a well flow (oil/water/gas/particles) through a pipeline from one or a number of well heads (not shown) on the sea floor. From the liquid chamber of separator 2 a conduit 5 extends to pump 3. A mixture of oil, water, and particles will, thus, flow through conduit 5. In pump 3 this liquid flow will receive transport energy to pass on through conduit 6. From the gas chamber of the separator a conduit 7 extends to compressor 4. Here, the gas will receive transport energy to pass on through conduit 8.

Conduits 6 and 8 may, if desired, be joined to a common further pipeline.

The motors of pump 3, and compressor 4, respectively, are designated M. Power supply to motors M is indicated by dashed lines 9.

Figure 2:
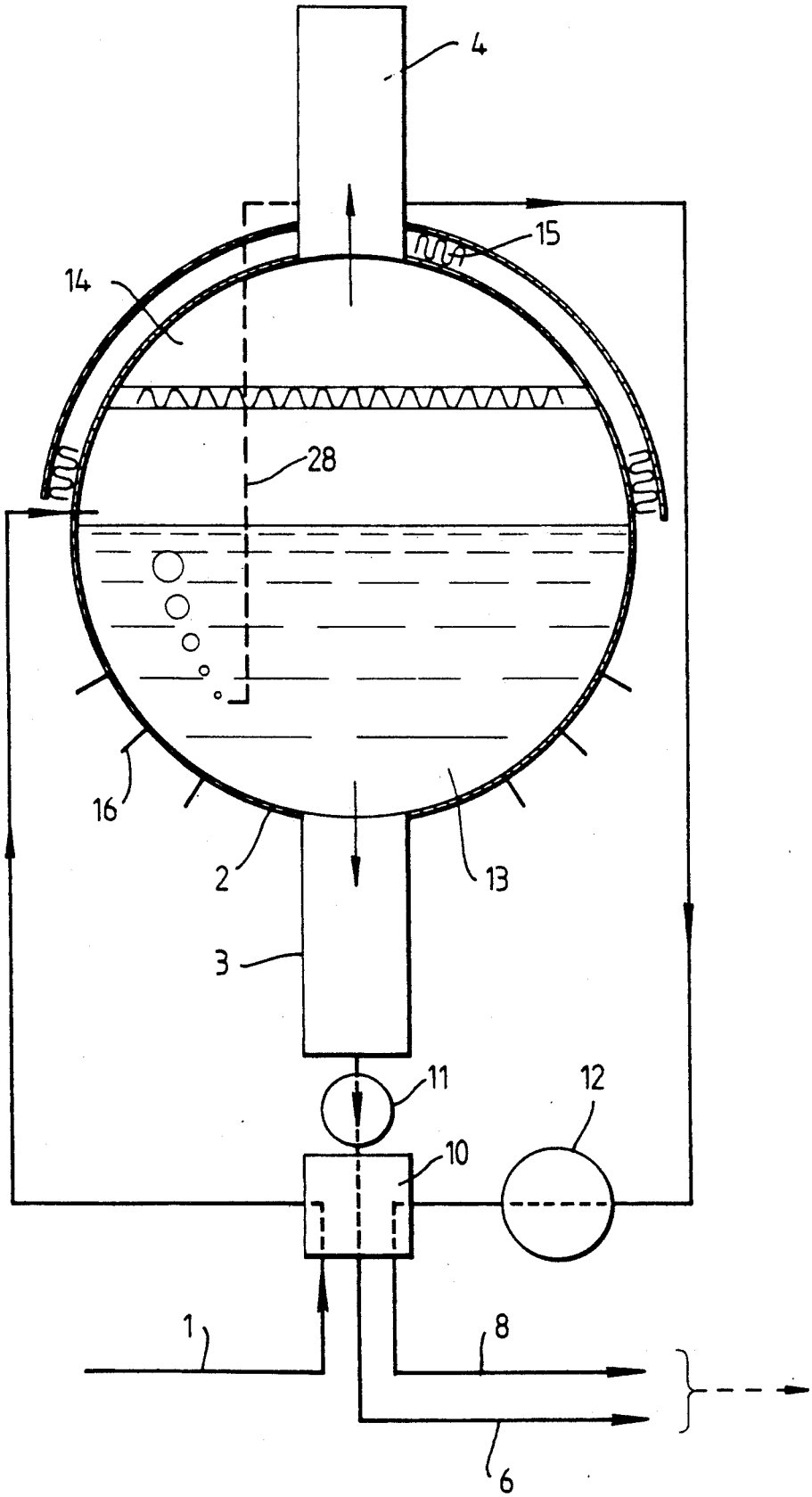
FIG. 2 is a diagrammatical view of the build-up of the new station.

FIG. 2 basically shows how the underwater station may be built to form a compact unit according to the invention. The same reference numerals as in FIG. 1 are used for corresponding components of the station.

As will appear from FIG. 2, separator 2, pump 3, and compressor 4 (motors are not shown in FIG. 2) are assembled to form a compact unit. All three components are provided in the shown column structure with the pump lowermost, then the separator, and the compressor on top. The fluid carrying conduits 1, 6, and 8 are joined in a common connection unit 10 at the bottom of the column structure. In gas conduit 8 a gauge 12 is provided. Correspondingly, a gauge 11 is provided in conduit 6.

By gauging pure gas and liquid phases separately, the problem of multi-phase gauging is, thus solved and continuous monitoring of the hydrocarbon flow is possible.

If desired, liquid conduit 6 and gas conduit 8 may be joined into a common further conduit, as indicated by a dashed arrow at the bottom of FIG. 2.

The inlet of pump 3 is directly connected with liquid chamber 13 of the separator and, correspondingly, the inlet of compressor 4 is directly connected with gas chamber 14 of the separator.

It will appear from the elementary diagram in FIG. 2 that both assemblies, i.e. both pump assembly with pump 3, and compressor unit with compressor 4, are self-draining, i.e. gas may bubble up from the pump, and liquid may drip down from the compressor.

Gas chamber 14 of the separator may, advantageously, be insulated, as indicated by insulation 15. Liquid chamber 13 of the separator may, advantageously, be provided with cooling ribs 16. By the aid of these measures stabilization of the phases, i.e. the liquid phase and the gas phase, may be achieved.

Figure 3:
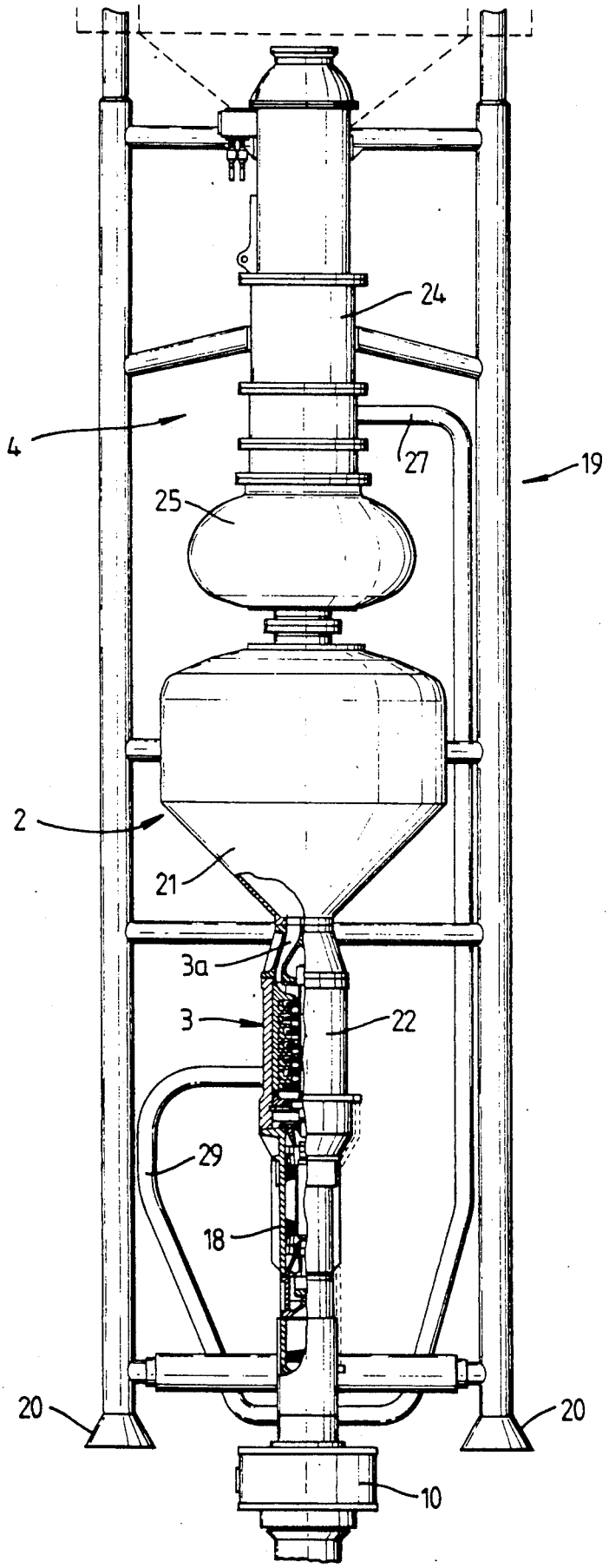
FIG. 3 shows a half-section through an underwater station according to the invention.

In FIG. 3 a preferred embodiment of the invention is shown, designed as a compact unit comprising a separator, a pump, and a compressor and intended to be placed on the sea floor. The booster-unit shown in FIG. 3, preferably, is dimensioned like a blow-out preventer (BOP). Such a unit may be installed by the aid of a drilling rig or a modified diving vessel having a large moon pool.

In FIG. 3 the same reference numerals as in FIGS. 1 and 2 are used for essential components.

Thus, separator 2 in FIG. 3 is a container having a cylindrical upper portion and a conical bottom portion. Pump 3 in FIG. 3 is a multistage centrifugal pump, and compressor 4 is a multistage rotational compressor. As shown, said components are joined into a compact unit in a column structure. Lowermost there is a common connecting unit or connector 10.

Both compressor and pump are centrifugal vertical machines in FIG. 3. Motor 17 of compressor 4 is placed on top, and motor 18 of pump 3 is placed below the pump in the column structure. The motors are vertical electric motors (asynchronous motors) having separate rpm control.

As shown in FIG. 3, the column structure is provided in a framework 19 comprising guide funnels 20 for co-operation with guide posts in a standard module pattern, in a manner known per se, e.g. as known from blow-out preventers and other equipment which is intended to be run down and installed at a desired place on the sea floor.

Advantageously, the gas chamber of separator 2 may be thermally insulated, if desired, or it may be provided with heating means, although this is not shown in FIG. 3. The liquid chamber of separator 2 may also be provided with cooling means, e.g. external cooling ribs, as shown in FIG. 2, where insulation is designated 15 and cooling ribs are designated 16. In FIG. 3 part of the cylindrical portion and all of the spherical portion form the gas chamber, whereas the liquid chamber is formed by part of the cylindrical portion and all of the conical bottom portion 21.

Conical bottom 21 of the separator is advantageous because it provides for draining of particles and pollution down to pump 3. As shown, inlet 3*a* of the pump is directly connected with the liquid chamber of separator 2.

Pump 3 and its motor 18 are provided in a common pressure shell 22 which is closed outwards. This pressure shell is constructed from a plurality of tightly joined casing members.

Compressor 4 and its motor 17, as well as a gear 23 provided between compressor and motor in the present case, are also provided in a common pressure shell 24, which is constructed from a plurality of tightly joined casing members by the aid of indicated flange couplings.

The lower portion of pressure shell 24 is designed to be a reservoir 25 for bearing luboil for lubrication of the bearings of the compressor/motor/gear.

The inlet side of compressor 4 is directly connected with the gas chamber of separator 2 by the aid of a short pipe 26. The pressure side of the compressor is connected with a pipeline 27 extending downwards to connector 10 on the outside of the column structure. Furthermore, a conduit 28 extends from the pressure side of the compressor, through which gas may be returned to separator 2 (see FIG. 2).

Pump 3 is connected with connector 10, via conduit 29. Connector 10 has three outlets (see also FIG. 2), but only one passage 30 is shown in the half section of FIG. 3. Passage 30 is connected with well flow passage 31 which in turn is in connection with a well head to which the connector 10 is intended to be connected (see also FIG. 5). Passage 30 is connected with the internal space of separator 2, via a pipeline (which extends upwards at the rear of the column structure), in a manner not shown in detail.

Figure 4:
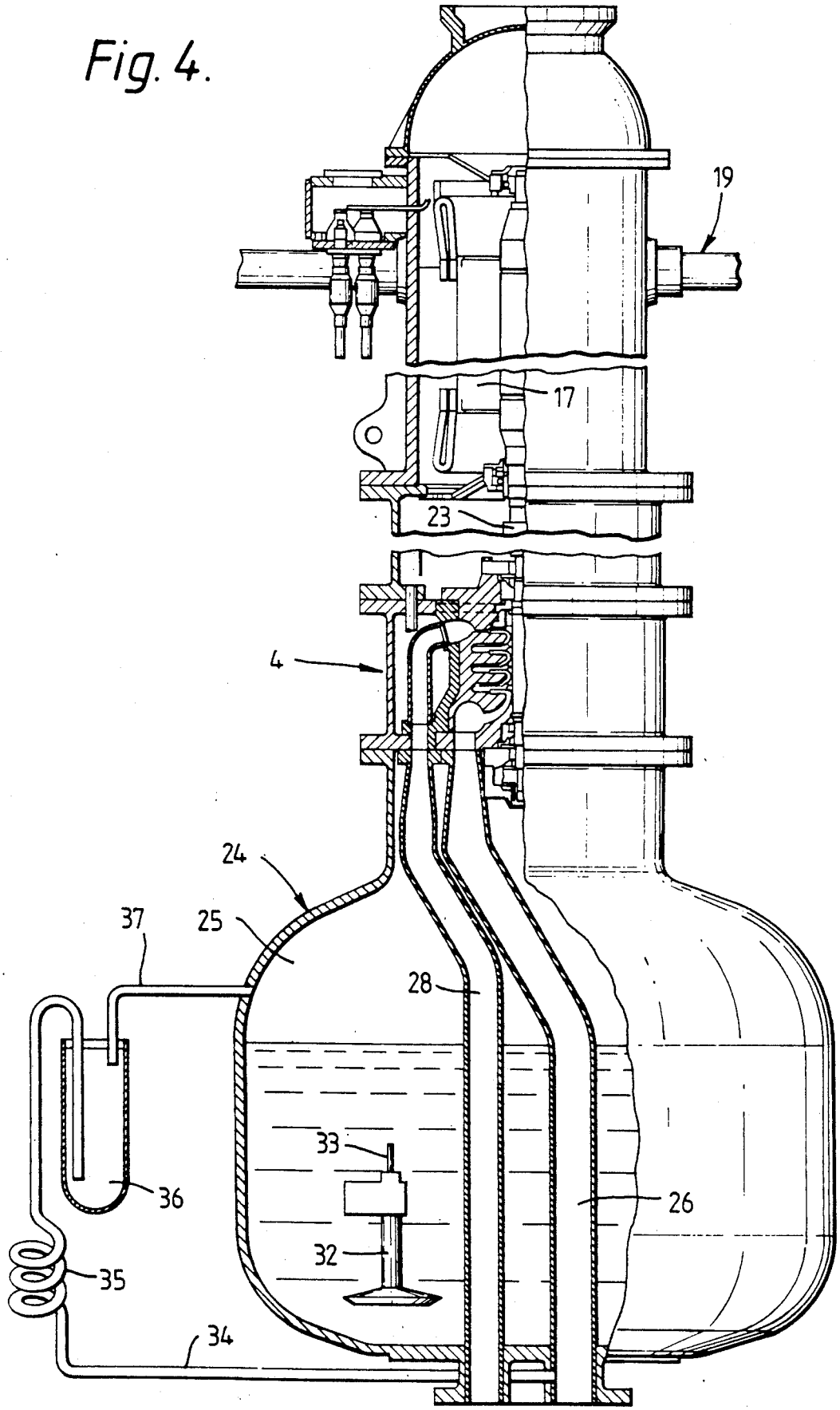
FIG. 4 shows an enlarged and shortened half-sectional view of the compressor assembly of the station.

In compressor assembly 4, 17 rotating seals which seal against high pressure gradients and are subjected to high loads will not be necessary. Rotating seals are provided at each end of the compressor to prevent too much consumption of lubricating oil. The shaft bearings are oil lubricated and are supplied with oil by a luboil pump 32 (FIG. 4). The luboil pump is driven by a driving shaft 33 from gear 23 in a manner not shown in detail. From luboil pump 32 luboil conduits extend to each bearing in a manner not shown.

When hydrocarbon fluids are compressed a condensate may be separated. It is necessary to keep condensate within certain limits to prevent such condensate from damaging the lubricating oil. FIG. 4 shows diagrammatically how it may be ensured that condensate is not separated in the compressor assembly proper, but outside the same, with recirculation of the condensate to the inlet side of the compressor.

In order to achieve this effect, a fluid conduit 34 is provided between inlet conduit 26 of the compressor and the interior space of pressure shell 24. Fluid conduit 34 comprises a cooling stretch 35 and a condensate trap 36. In fluid conduit 34 only slight "breathing" will occur. Condensate will collect in condensate trap 36, whereas conduit portion 37 extending from the gas portion of the condensate trap to interior space of pressure shell 24, i.e. into reservoir 25, will transport "dry" gas. With a suitable arrangement and dimensioning of the fluid connection a condensate trap may, if desired, be omitted. During installation and running in the compressor assembly is, advantageously, filled with inert gas. A suitable inert gas will be nitrogen. This gas will gradually diffuse, or be replaced by compressed gas, respectively. The filling of inert gas in the pressure shell will prevent presence of air (oxygen) inside the pressure shell. Displacement/replacement of the inert gas will cause no consequences as to safety due to the fact that it was ensured from the very beginning that oxygen is excluded from the interior space of the pressure shell.

It will be understood that when compressor assembly and pump assembly are used under water the special design will permit full utilization of the cooling effect of surrounding sea water.

Electric drive motors 17, 18 may be connected directly, wet or dry, i.e. either by the aid of special wet electric connections or by having an electric cable which is long enough to be connected in a dry manner before the whole structure is run down. The same method of connection may, obviously, be used for signal cables.

It should be possible to adjust the capacity of delivery and pressure rise of a given compressor assembly or pump assembly, respectively. As mentioned, this may be achieved by making the electric driving motors adjustable as to rpm.

It is intended that the compact unit (column structure with framework) should be retrieved at predetermined intervals for maintenance or status test. A new compact unit, or an overhauled unit, may then be used to replace the retrieved unit. The compressor assembly as well as the pump assembly may, advantageously, be designed to permit internal parts to be replaced in connection with maintenance (more or less stages in the compressor motor/pump motor), and the electromotor may also be changed, if desired. In this manner capacity may be adjusted within certain limits as conditions of the reservoir change with time (changes of pressure and gas volume).

The compressor assembly and pump assembly may, advantageously, be designed in a number of standard sizes, so that a total compressor and/or pump capacity which is optimally adapted to existing field conditions may be achieved by selection of standard size and number of units. Units of the same size will be identical and, thus, interchangeable. Units of different sizes will, preferably, have equal vital dimensions for connection and mounting, so that units of different capacity may be readily replaced. This means that it will be possible to adapt to actual conditions whenever it may be desired by changing to different standard sizes during the lifetime of a field. As mentioned, fine adjustment will also be possible by exchanging internal components of various standard sizes and, if desired, by changing the rpm.

Connector 10 of the shown embodiment is of a kind known per se, cf. e.g. NO-PS 155 114.

Figure 7:
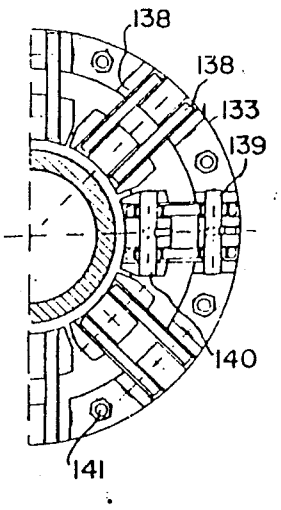
FIG. 7 PRIOR ART
FIG. 7 shows a combined cross section and end view of the holding ring and appurtenant components.
Figure 6:
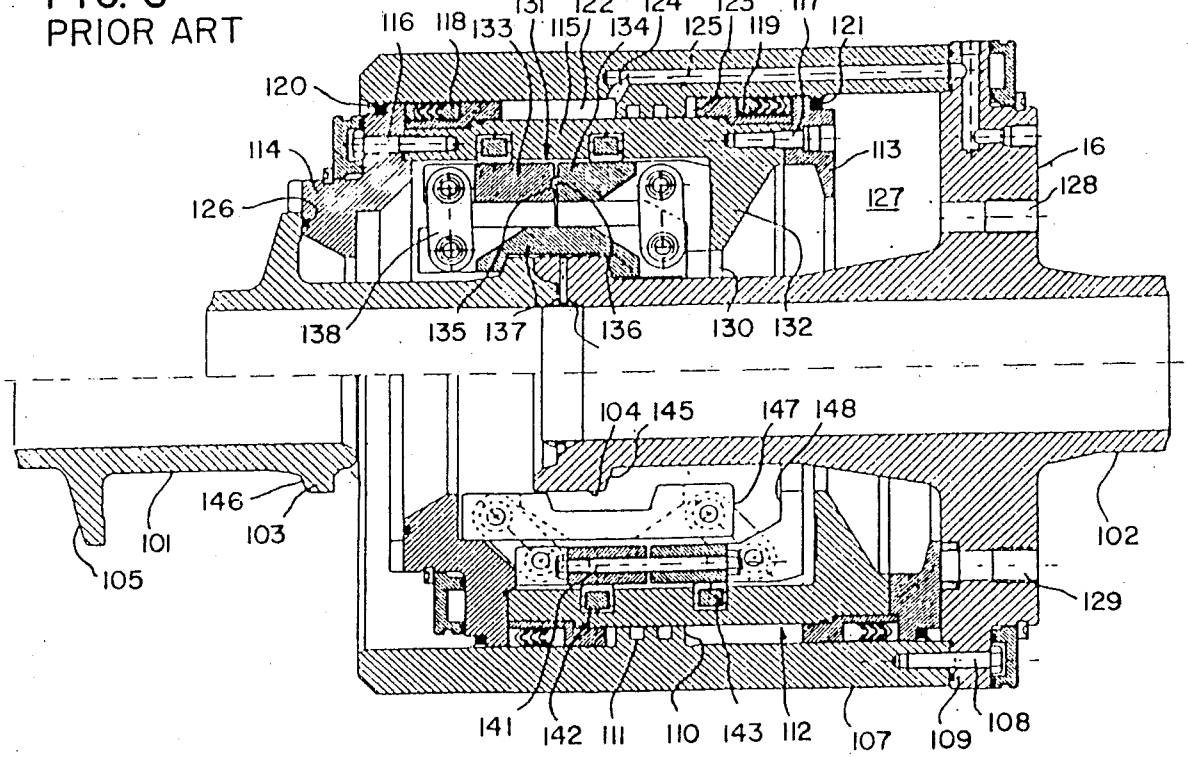
FIG. 6 PRIOR ART
FIG. 6 shows a cross section through a connector according to the invention the upper section showing the connector in closed position while the lower section shows the connector in open position.

A connector, like shown in NO-PS 155, 115 is illustrated in FIGS. 6 and 7. The connector for joining two pipelines 101 and 102. Pipeline 101 is formed with a coupling flange 103 at the end thereof, and pipeline 102 is formed with a coupling flange 104 at its coupling end. A short distance inwards from the coupling flange 103 the pipeline 101 is provided with another flange 105, and pipeline 102 is similarly provided with a flange 106 located inwards from its coupling flange 104.

A cylinder 107 is mounted with one end surface thereof on the flange 106 and secured thereto by means of a plurality of screws 108. Between the cylinder's end surface and the flange are inserted suitable seals members, for example O-rings 109. The interior of cylinder 107 has a collar 110 in which are inserted two encircling sealing rings 111 providing sliding seal against an annular piston 112 disposed in the cylinder.

This annular piston 112 is constructed of a plurality of parts, namely a first ring piston crown 113, a second ring piston crown 114 and an intermediate piston skirt 115. The piston ring crowns and the piston skirt are held together by means of screw bolts 116, 117. The piston skirt 115 has a recess at each end, into which recess is placed a respective sealing member 118, 119. These sealing members provide sliding seals against the interior wall of cylinder on each side of the collar 110. A lip seal 120, 121 is also provided on each ring piston crown.

This construction design forms work spaces 122, 123, respectively, on each side of the collar 110. These work spaces are connected with respective working fluid lines 124, 125, enabling pressurization or depressurization of the work space as needed.

The annular piston crown 114 is equipped with a ring seal 126 at the end side thereof facing flange 105, providing a seal against flange 105 in the connector's closed position (upper half section shown in FIG. 6). In the connector's closed position there would thus be a closed chamber 127 within the cylinder housing formed by the cylinder 107 and the flange 106. A through-going bore 128 is made in flange 106 for connection of a flush line, not shown. In flange 106 there is also formed a through-going bore 129, again for connection to a flush line, not shown. While the bore 128 is positioned such that it will always remain free and thus open to the chamber 127, the bore 129 is placed so as to be closed by the annular piston crown 113 when the connector is in its open position (lower half of FIG. 6).

The piston skirt 115 is cup-shaped, as shown, with an opening 130 at the center of the cup base. Placed within the annular piston 112 is a holding ring 131 having limited axial movability within said annular piston, between the piston ring crown 114 and the base portion 132 of the cup-shaped piston skirt 115.

The holding ring is built up of two ring members 133, 134, resting against one another as shown, said ring member 133 having an encircling groove 135 which engages with an encircling ridge 136 on the ring member 134. This enables reciprocal twisting of the two ring members in the axial section.

Provided in the opening of the holding ring 131 are a plurality of clamping blocks 137. Each of these is suspended in said holding ring by means of links 138. In the embodiment example each clamping block 137 is suspended by means of four links 138, the clamping block being suspended from two links in ring member 133 and from two other links in ring member 134. Each clamping block is thus mounted in the holding ring by means of a parallel chain mechanism comprising four links 138, mounted articulately in, respectively, the holding ring and the clamping block by means of respective pins 139, 140 (FIG. 7).

The two ring members 133, 134 are held together by means of a plurality of bolts 141.

In the embodiment example, there are provided elastically resilient sliding pads 142, 143, inserted in the annular piston, between the interior wall of the piston skirt 115 and the holding ring 131.

Figure 5:
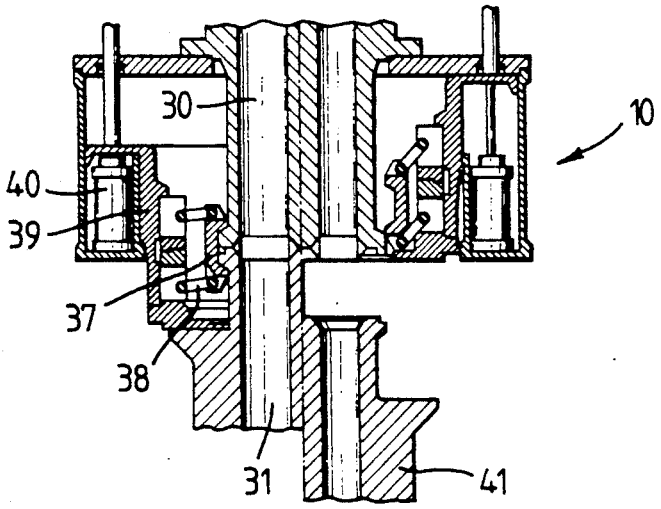
FIG. 5 is a sectional view through a connector which is a component of the new station, at the same scale as in FIG. 4.

Connector 10 shown in the drawings, especially in FIG. 5, is a variant of the known connector and in principle operates in the same manner.

As shown, connector 10 comprises clamping blocks 37 which are, via links 38, connected with a holding ring 39, which is slidable axially in the connector casing with operating cylinders 40, as shown. When connector 10 is joined with connecting head 41, as shown in the left side half of FIG. 5, and when holding ring 39 is displaced, clamping blocks 37 will be made to clamp about coupling flanges on connecting head 41, and connector 10, respectively. Other connectors, e.g. a connector which is marketed by "Cameron", may obviously be used.

We claim:

1. In an underwater station for pumping a well flow, a separator to separate the well flow into liquid and gas, said separator including a pressure vessel comprising an upper gas chamber and a lower liquid chamber, a pump and a pump motor arranged in a first common pressure shell, a compressor and a compressor motor arranged in a second common pressure shell, said pressure vessel, first and second common pressure shells being joined into a compact column structure unit having a lower end, with the first common pressure shell lowermost, then the pressure vessel, and the second common pressure shell uppermost, said pressure vessel and first and second common pressure shells being directly exposed to ambient water when arranged in an underwater station, fluid carrying conduits between said separator and pump, and compressor, respectively, said fluid carrying conduits being joined in a common connector at the lower end of said column structure unit.

2. In an underwater station as defined in claim 1, said pump having an inlet directly connected with the liquid chamber of the separator, and said compressor having an inlet directly connected with the gas chamber of said separator.

3. In an underwater station as defined in claim 1, said compressor and said pump both being vertical centrifugal machines, with the motor of said compressor uppermost, and with the motor of said pump lowermost in the column structure unit.

4. In an underwater station as defined in claim 1, the gas chamber of separator being thermally insulated, and the liquid chamber of the separator being provided with cooling means, e.g. external cooling means.

5. In an underwater station as defined in claim 1, said second common pressure shell including a bottom section forming a reservoir for bearing luboil, said compressor having an inlet, a fluid conduit between said inlet and said bottom part of said second common pressure shell, with a cooling stretch provided in said fluid conduit, said fluid conduit including a condensate trap having a gas portion, said gas portion being connected with said bottom part in said second common pressure shell.

6. An underwater station for pumping a well flow, comprising:

a separator to separate the well flow into liquid and gas;

a pump assembly comprising a pump with a motor;

a compressor assembly comprising a compressor with a motor; said compressor and its motor being in a common pressure shell defining an internal space and having a bottom, said bottom being a reservoir for luboil;

fluid carrying conduits between separator and pump, and compressor, respectively; and a conduit between inlet of said compressor and the internal space of said pressure shell, with a cooling stretch provided in the fluid conduit connection and a condensate trap, the gas portion of which is connected with the internal space of the pressure shell;

said components separator, pump assembly, and compressor assembly being joined into a compact unit with all three components arranged in a column structure with said pump assembly being lowermost, and with said compressor assembly being uppermost; said fluid carrying conduits being designed for connection at the bottom of the column structure.

* * * * *